US007478768B2

(12) United States Patent
Yip

(10) Patent No.: US 7,478,768 B2
(45) Date of Patent: Jan. 20, 2009

(54) UTILITY HAND-PIECE WITH INTEGRATED FLUID CHANNEL

(76) Inventor: Jennifer Yip, 7820 Village Harbor Dr., Cornelius, NC (US) 28031

( * ) Notice: Subject to any disclaimer, the term of this patent is extended or adjusted under 35 U.S.C. 154(b) by 17 days.

(21) Appl. No.: 11/634,421

(22) Filed: Dec. 6, 2006

(65) Prior Publication Data

US 2008/0135113 A1 Jun. 12, 2008

(51) Int. Cl.

| | |
|---|---|
| ***B05B 9/08*** | (2006.01) |
| ***B05B 7/02*** | (2006.01) |
| ***B05B 9/01*** | (2006.01) |
| ***B05B 1/00*** | (2006.01) |
| ***A62C 15/00*** | (2006.01) |

(52) U.S. Cl. ..... 239/529; 239/154; 239/211; 239/525; 222/78; 401/8; 15/227

(58) Field of Classification Search ..... 239/154, 239/211, 529, 525; 222/78, 175; 401/7, 401/8; 119/665; 15/222, 227; 2/160
See application file for complete search history.

(56) References Cited

U.S. PATENT DOCUMENTS

| | | | | | |
|---|---|---|---|---|---|
| 1,558,930 | A | * | 10/1925 | Schuck | 239/529 |
| 2,132,459 | A | * | 10/1938 | Cockeroft | 239/529 |
| 4,903,864 | A | * | 2/1990 | Sirhan | 222/78 |
| 5,158,208 | A | * | 10/1992 | Wilson | 222/78 |
| 5,303,847 | A | * | 4/1994 | Cottone | 222/78 |
| 5,466,080 | A | * | 11/1995 | Lee | 401/7 |
| 5,722,349 | A | * | 3/1998 | Wolgamuth | 119/665 |

* cited by examiner

*Primary Examiner*—Len Tran
*Assistant Examiner*—Ryan Reis
(74) *Attorney, Agent, or Firm*—Schwartz Law Firm, P.C.

(57) ABSTRACT

A utility hand-piece is adapted for being worn on a hand of a user. The hand-piece includes a body portion adapted for covering at least a portion of the hand, and incorporating at least one fluid channel. A fluid inlet is formed with the body portion and communicates with the fluid channel. A fluid outlet is formed with the body portion and communicates with the fluid channel downstream of the fluid inlet. Upon connecting a fluid source to the hand-piece, fluid is transferred from the fluid inlet through the fluid channel and dispensed from the body portion through the fluid outlet.

18 Claims, 7 Drawing Sheets

UTILITY HAND-PIECE WITH INTEGRATED FLUID CHANNEL

TECHNICAL FIELD AND BACKGROUND OF THE INVENTION

This invention relates to a utility hand-piece with an integrated fluid channel. The invention is especially applicable for receiving and dispensing a fluid, such as water, air, steam, oils, shampoo, hair conditioner, lotions, creams, and other fluid/gel products. In one exemplary implementation, the invention is used in the spa and massage therapy industry as a fluid dispensing implement for facials, body massages, pedicures, manicures, and the like.

SUMMARY OF THE INVENTION

Therefore, it is an object of the invention to provide a utility hand-piece which incorporates at least one integrated fluid channel.

It is another object of the invention to provide a utility hand-piece which is applicable in personal spa treatments including facials, manicures, pedicures, and body massages.

It is another object of the invention to provide a utility hand-piece which allows free use of the hand and fingers while simultaneously dispensing a fluid, such as (for example) water, air, steam, oils, shampoo, hair conditioner, lotions, creams, and other fluid/gel products.

It is another object of the invention to provide a utility hand-piece which is applicable in a wide variety of industries including, for example, spa and massage therapy, nursing homes, hospitals, restaurants, and industrial plants.

These and other objects of the present invention are achieved in the exemplary embodiments disclosed below by providing a utility hand-piece for being worn on a hand of a user. The hand-piece includes a body portion adapted for covering at least a portion of the hand, and defining at least one fluid channel therein. The fluid channel may be integrally formed with the body portion, or formed separately using, for example, a flexible tube or the like. A fluid inlet is formed with the body portion and communicates with the fluid channel. A fluid outlet is formed with the body portion and communicates with the fluid channel downstream of the fluid inlet. Upon connecting a fluid source to the hand-piece, fluid is transferred from the fluid inlet through the fluid channel and dispensed from the body portion through the fluid outlet.

According to another exemplary embodiment of the invention, the body portion defines a plurality of divided fluid channels therein communicating with the fluid inlet.

According to another exemplary embodiment of the invention, a plurality of fluid outlets communicate with respective fluid channels.

According to another exemplary embodiment of the invention, the body portion defines three divided fluid channels therein communicating with the fluid inlet.

According to another exemplary embodiment of the invention, at least three fluid outlets communicate with respective fluid channels.

According to another exemplary embodiment of the invention, the body portion includes at least one finger opening adapted for receiving a finger of the user.

According to another exemplary embodiment of the invention, the finger opening is a finger loop.

According to another exemplary embodiment of the invention, the body portion includes a plurality of finger openings adapted for receiving respective fingers of the user.

According to another exemplary embodiment of the invention, a plurality of fluid outlets are located proximate respective finger openings.

According to another exemplary embodiment of the invention, an adjustable wrist strap is attached to the body portion and adapted for wrapping around a wrist of the user.

According to another exemplary embodiment of the invention, the body portion incorporates overlying top and bottom layers, and the fluid channel is integrally formed between the top and bottom layers.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF EXEMPLARY EMBODIMENTS AND BEST MODE

The present invention is described more fully hereinafter with reference to the accompanying drawings, in which one or more exemplary embodiments of the invention are shown. This invention may, however, be embodied in many different forms and should not be construed as limited to the embodiments set forth herein; rather, these embodiments are provided so that this disclosure will be operative, enabling, and complete. Like numbers refer to like elements throughout. As used herein, the article "a" is intended to include one or more items. Where only one item is intended, the term "one" or similar language is used. Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. Any references to advantages, benefits, unexpected results, or operability of the present invention are not intended as an affirmation that the invention has been previously reduced to practice or that any testing has been performed.

Figure 1:
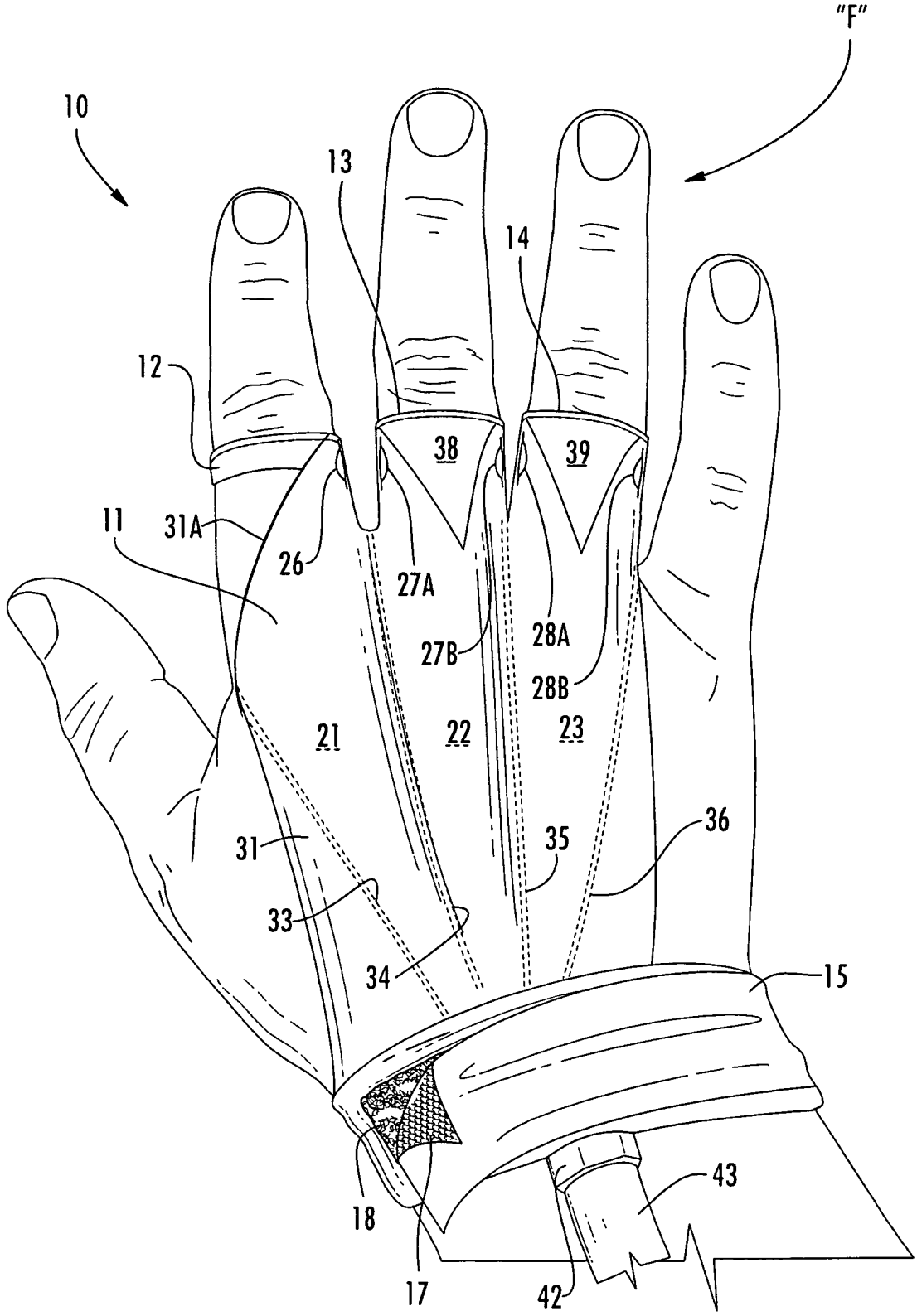
FIG. 1 is an environmental view of the hand-piece according to one exemplary implementation of the present invention, and showing the hand-piece worn on the hand of a user.
Figure 2:
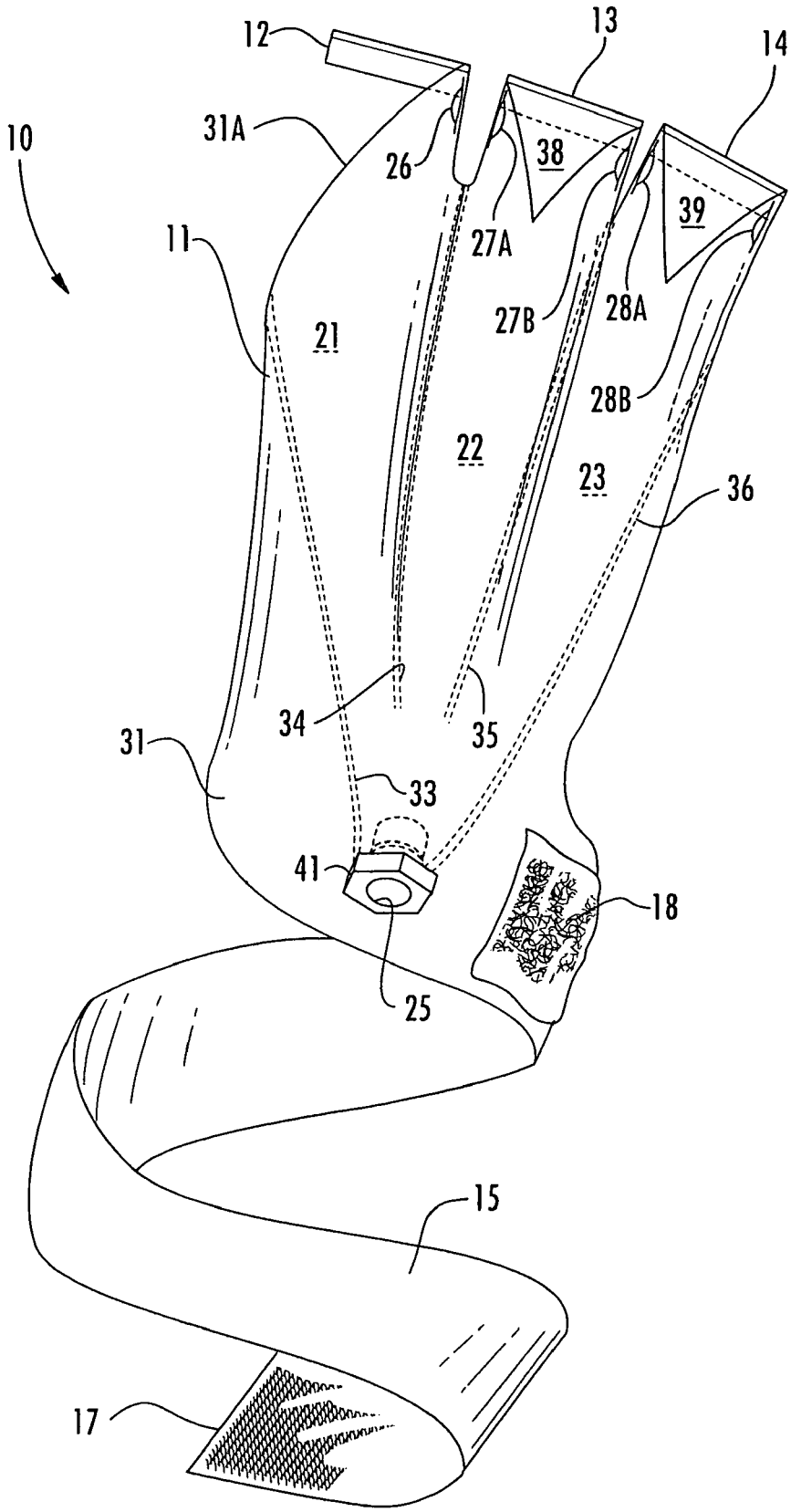
FIG. 2 is a perspective view of the hand-piece removed from the hand.

Referring now specifically to the drawings, a utility hand-piece according to one exemplary embodiment of the present invention is illustrated in FIGS. 1 and 2, and shown generally at reference numeral 10. The hand-piece 10 is particularly applicable for use in the spa and massage therapy industry. In one exemplary implementation, the hand-piece 10 comprises a flexible open-palm body portion 11, finger loops 12, 13, and 14, and a wrist strap 15. The wrist strap 15 wraps around the wrist of the user, and has complementary hook and loop fasteners 17 and 18 which selectively mate together to allow an adjustable fit. The body portion 11 of the hand-piece 10 incorporates divided fluid channels 21, 22, and 23 designed for receiving water, oils, shampoo, hair conditioner, lotions, creams, and other fluid/gel products. Each of the fluid channels 21, 22, 23 communicates with an inlet 25 formed near the wrist strap 15, and a number of relatively small dispenser ports 26, 27A, 27B, and 28A, 28B formed downstream of the inlet 25 near the finger loops 12, 13, and 14. The dispenser ports 26, 27A, 27B, and 28A, 28B may be strategically located to dispense product outwardly between the fingers of the user.

Figure 3:
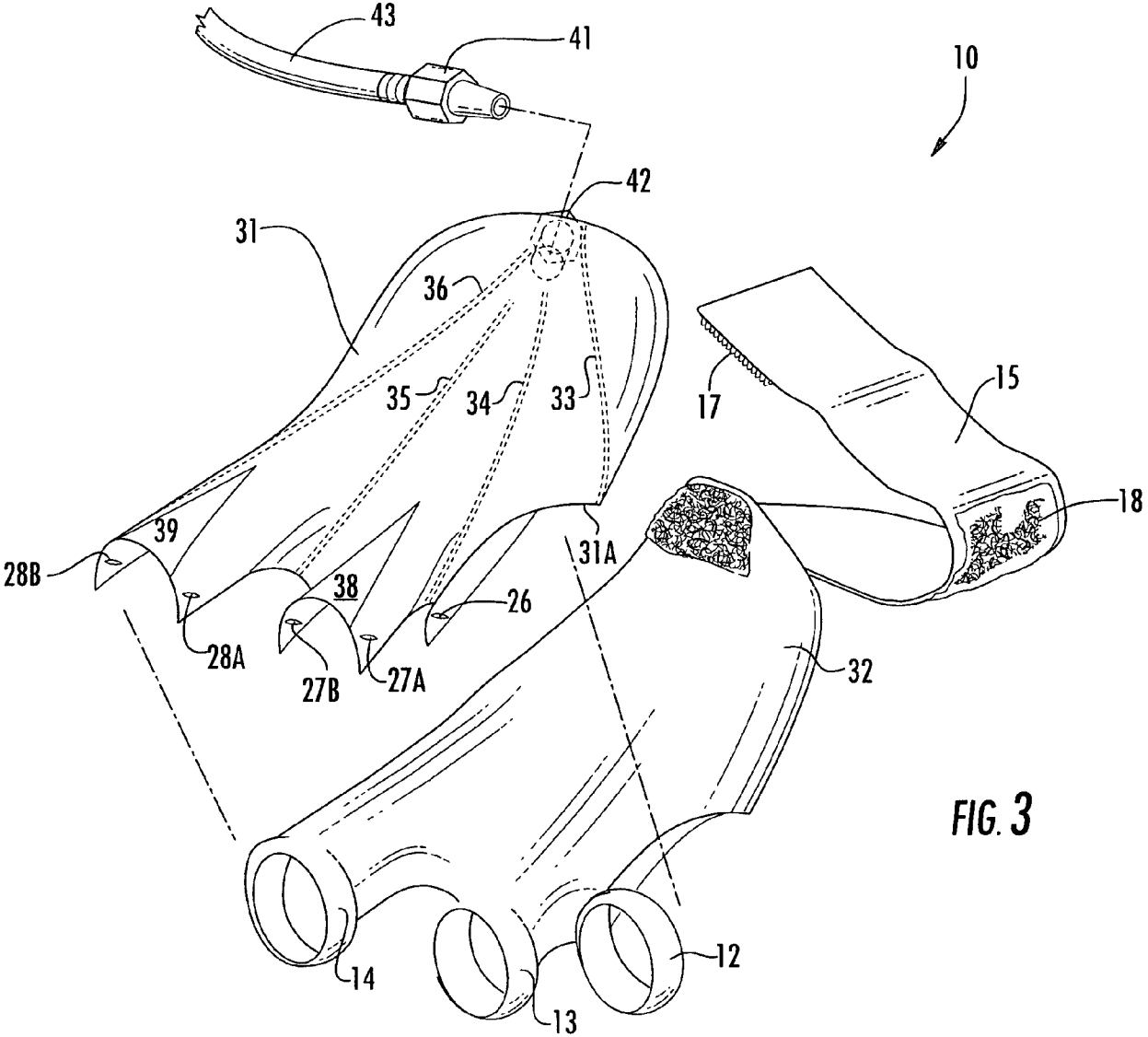
FIG. 3 is an exploded view of the hand-piece showing the top layer pulled away from the bottom layer.
Figure 4:
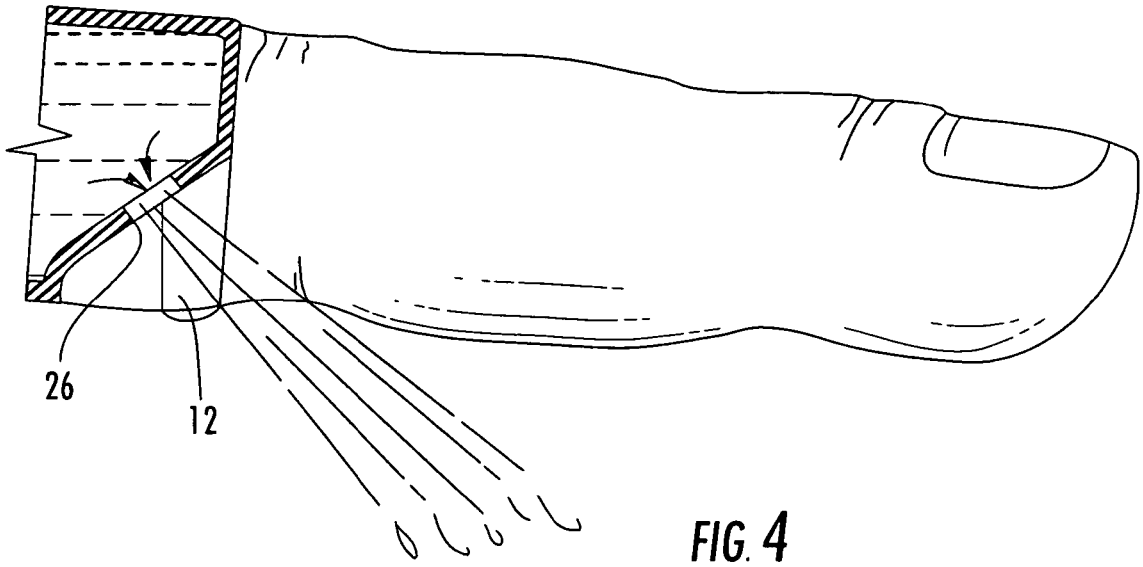
FIG. 4 is an enlarged, fragmentary cross-section showing a dispenser port of the hand-piece, and demonstrating the dispensing of fluid outwardly towards a palm-side of the hand.
Figure 5:
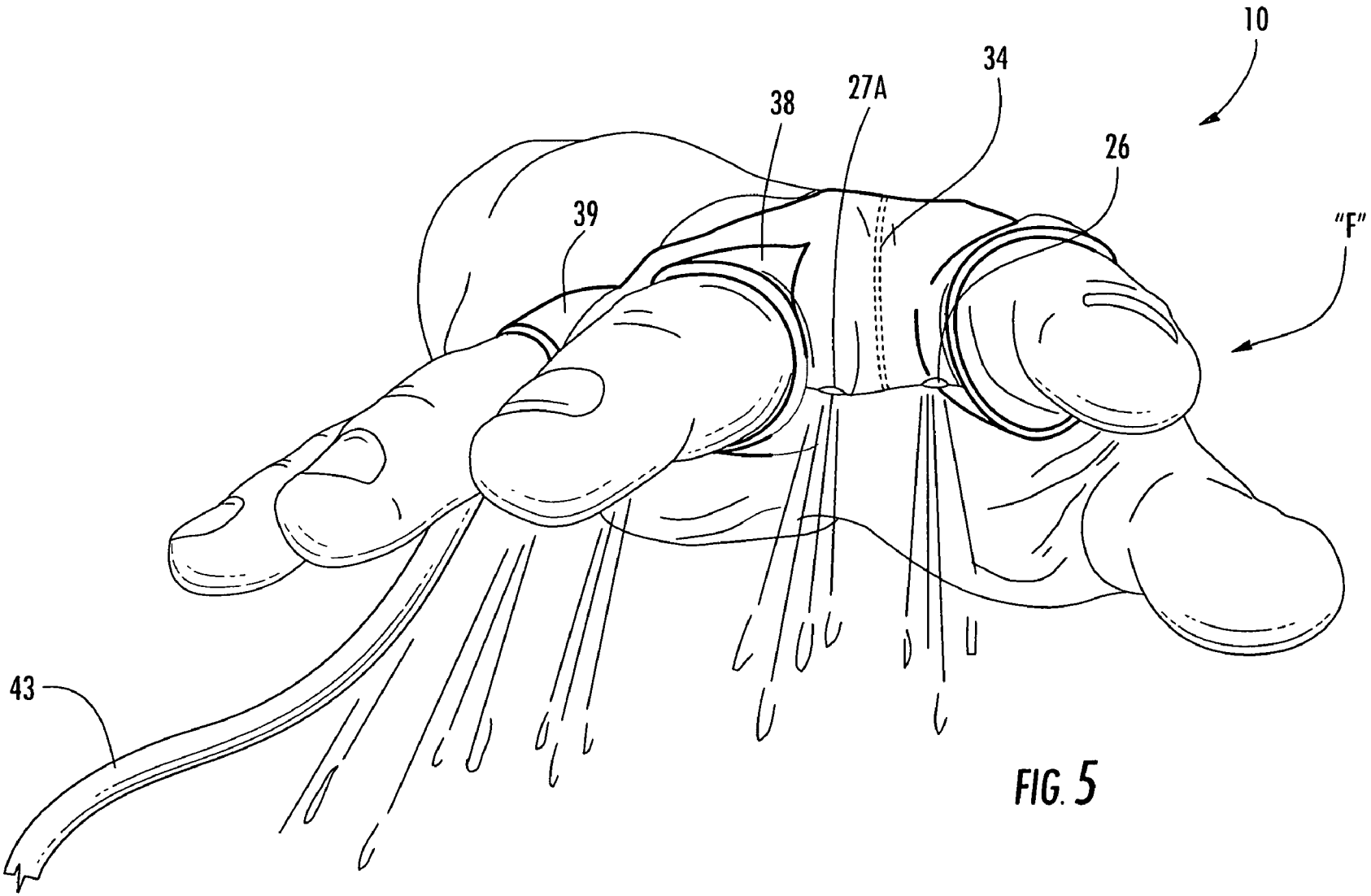
FIG. 5 is a further environmental view of the hand-piece shown on the hand of a user, and demonstrating the dispensing of fluid outwardly between the fingers and towards a palm-side of the hand.

In one embodiment, the hand-piece 10 comprises overlying top and bottom layers 31 and 32 (shown in FIG. 3) formed of a soft and stretchable neoprene, and joined together along a perimeter edge 31A of the top layer 31 and at intermediate longitudinal channel lines 33, 34, 35, and 36. The top and bottom layers 31, 32 may be joined together using a substantially water-tight, single or double fluid seam weld construction. The seams 31A, 33, 34, 35, 36 may also be stitchless and glued, glued and blind-stitched, taped, or formed in any other suitable manner creating a substantially water-tight connection. Fluid channel 21 extends from the inlet 25 to dispenser port 26, and is formed between the top and bottom layers 31, 32 and between channels lines 33 and 34. Fluid channel 22 extends from the inlet 25 to dispenser ports 27A, 27B, and is formed between the top and bottom layers 31, 32 and between channels lines 34 and 35. Fluid channel 23 extends from the inlet 25 to dispenser ports 28A, 28B, and is formed between the top and bottom layers 31, 32 and between channels lines 35 and 36. As best shown in FIGS. 4 and 5, each dispenser port 26, 27A, 27B, and 28A, 28B may be formed to direct fluid outwardly between the fingers "F" and towards a palm side of the hand. In addition, triangular areas 38 and 39 of the top layer 31 adjacent the finger loops 13 and 14 may be adhered directly to the bottom layer 32 in order to divert fluid flow to opposite sides of respective fingers.

Referring again to FIGS. 1 and 3, the fluid inlet 25 may comprise a sealed male or female connector 41 formed with the body portion 11, and designed to mate with a complementary connector 42 located at a free end of a flexible fluid transfer tube 43. The opposite end of the fluid transfer tube 43 communicates with a source of fluid, and may be operatively connected to a foot pump, water tap or spout, or other means suitable for urging fluid through the tube 43 and into the hand-piece 10. The hand-piece 10 is especially useful in spa treatments, such as facials and body massages, leaving both hands and all fingers of the user free to touch and massage the customer.

Figure 6:
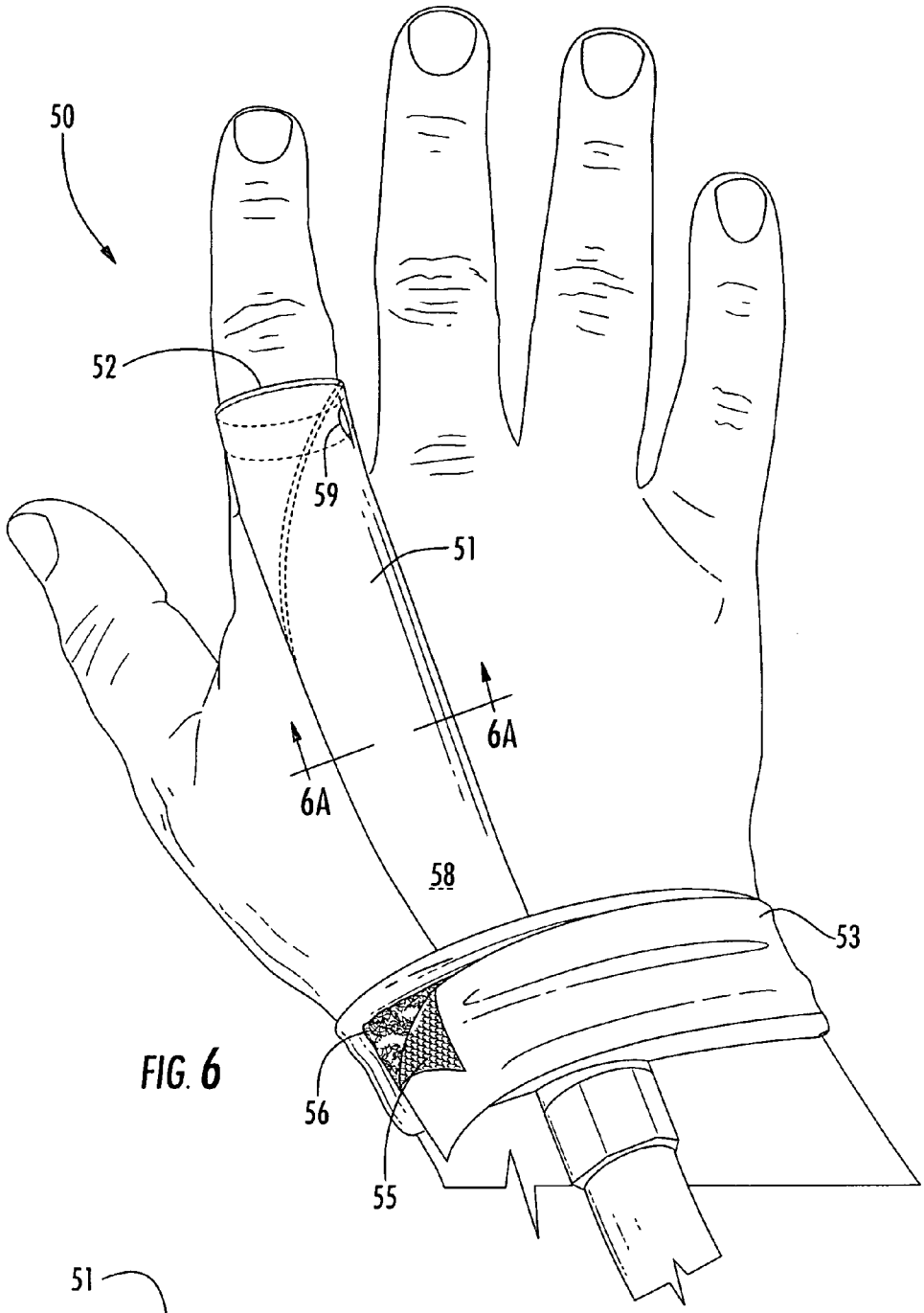
FIG. 6 is a perspective view of the hand-piece according to a further exemplary embodiment of the invention.
Figure 6A:
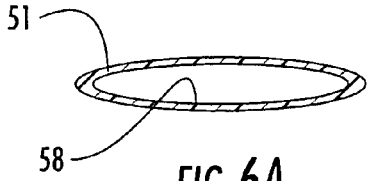
FIG. 6A is a cross-sectional view taken substantially along line 6-6 of FIG. 6.

An alternative implementation of the invention is illustrated in FIGS. 6 and 6A. The hand-piece 50 comprises a flexible tubular body portion 51, a single finger loop 52, and a wrist strap 53. As previously described, the wrist strap 53 wraps around the wrist of the user, and has complementary hook and loop fasteners 55 and 56 which selectively mate together to allow an adjustable fit. The body portion 51 of the hand-piece 50 defines an internal fluid channel 58 designed to receive a fluid. The fluid channel 58 communicates with an inlet (not shown) formed near the wrist strap 53, and a relatively small dispenser port 59 formed near the finger loop 52. The fluid inlet is preferably identical to that shown in FIG. 2, and may comprise a male or female connector formed with the body portion 51 and designed to mate with a complementary connector located at a free end of the fluid transfer tube. The hand-piece 50 operates to receive and dispense fluid in a manner identical to that previously described.

Figure 7:
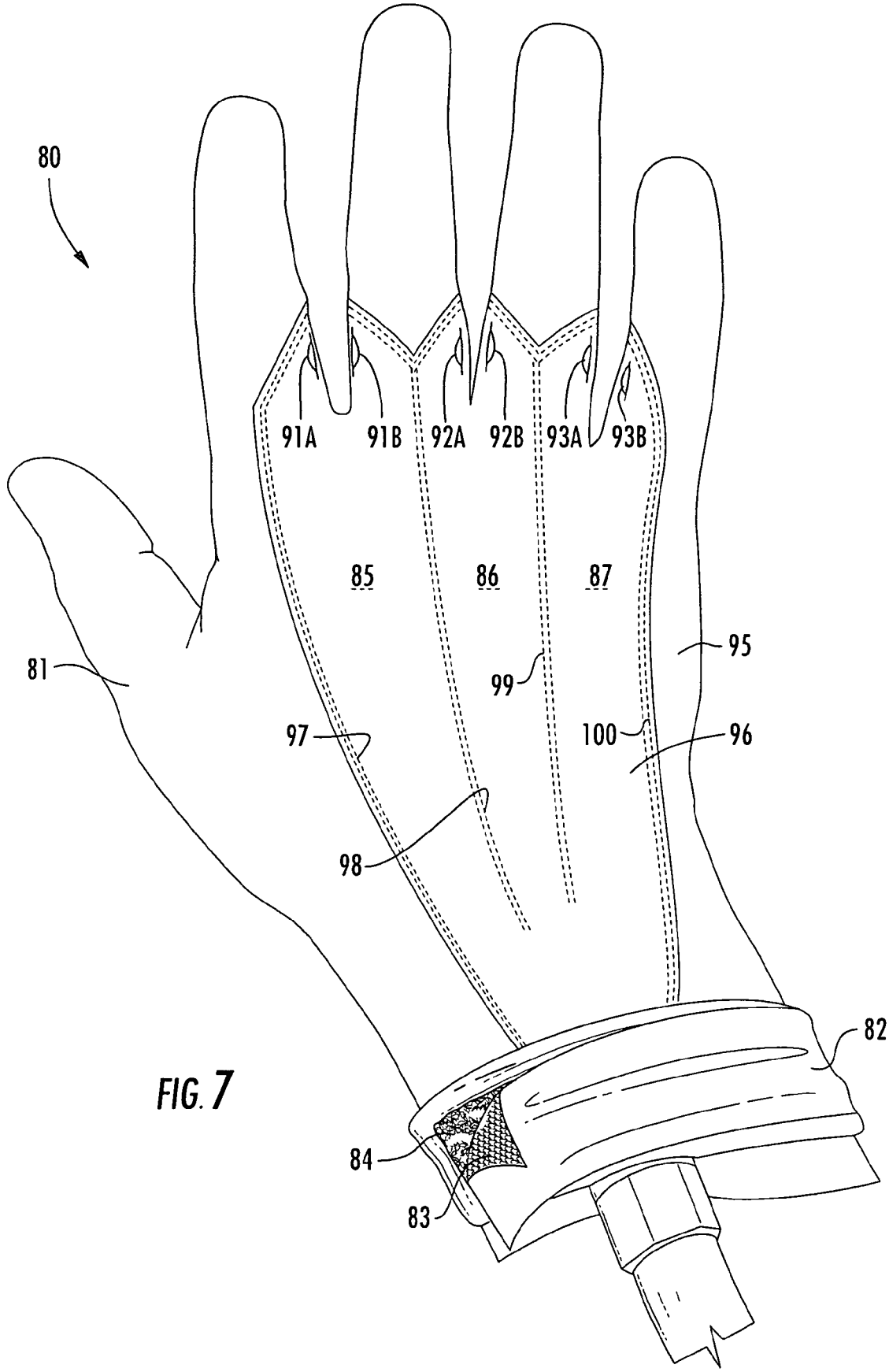
FIG. 7 is a perspective view of yet another embodiment of the hand-piece.

A further alternative implementation of the invention is illustrated in FIG. 7. The hand-piece 80 comprises a flexible body portion 81 and a wrist strap 82. As previously described, the wrist strap 82 wraps around the wrist of the user, and has complementary hook and loop fasteners 83 and 84 which selectively mate together to allow an adjustable fit. The body portion 81 of the hand-piece 80 incorporates divided fluid channels 85, 86, and 87 designed to receive and deliver a fluid at or near the fingers of the user. The fluid channels 85, 86, and 87 communicate with an inlet (not shown) formed near the wrist strap 82, and relatively small dispenser ports 91A, 91B, 92A, 92B, and 93A, 93B formed near the fingers of the body portion 81. The fluid inlet is preferably identical to that shown in FIG. 2, and may comprise a sealed male or female connector formed with the body portion 81 and designed to mate with a complementary connector located at a free end of the fluid transfer tube.

The body portion 81 of the hand-piece 80 comprises a full glove base 95 designed to cover the entire hand, and a separate overlying top layer 96. The glove base 95 has five finger openings for receiving the fingers and thumb of the user, respectively. The top layer 96 and at least an underlying outer surface of the glove base 95 may be formed of a soft, stretchable neoprene. The top layer 96 is joined to the glove base 95 along longitudinal channel lines 97, 98, 99, and 100 using a substantially water-tight, single double fluid seam weld construction. The seams 97-100 may also be stitchless and glued, glued and blind-stitched, taped, or formed in any other suitable manner creating a substantially water-tight connection. Fluid channel 85 extends from the inlet to dispenser ports 91A, 91B, and is formed between the top layer 96 and glove base 95, and between channel lines 97 and 98. Fluid channel 86 extends from the inlet to dispenser ports 92A, 92B and is formed between the top layer 96 and glove base 95, and between channels lines 98 and 99. Fluid channel 87 extends from the inlet to dispenser ports 93A, 93B and is formed between the top layer 96 and glove base 95, and between channels lines 99 and 100.

Like hand-piece 10 described above, each dispenser port 91A, 91B, 92A, 92B, and 93A, 93B may be formed to direct fluid outwardly between the fingers and towards a palm side of the hand. The hand-piece 80 operates to receive and dispense fluid in a manner identical to that previously described. The hand-piece 80 is particularly useful in industrial applications involving liquid cleaning products, and in nursing homes and hospitals for bathing and washing patients.

Exemplary embodiments of the present invention are described above. No element, act, or instruction used in this description should be construed as critical or essential to the invention unless explicitly described as such. Various details of the invention may be changed without departing from its scope. Furthermore, the foregoing description of the exemplary embodiments of the invention and best mode for practicing the invention are provided for the purpose of illustration only and not for the purpose of limitation—the invention being defined by the claims and their equivalents.

I claim:

1. A utility hand-piece for being worn on a hand of a user, said hand-piece comprising:

a body portion adapted for covering at least a portion of the hand, and comprising overlying top and bottom layers joined together along a plurality of longitudinal channel lines, wherein adjacent ones of said longitudinal channels lines cooperate to define at least one fluid channel in said body portion, said fluid channel being formed between said longitudinal channel lines and between said top and bottom layers of said body portion, and wherein each longitudinal channel line forms a seam in said body portion;

a fluid inlet formed with said body portion and communicating with said fluid channel; and a fluid outlet formed with said body portion and communicating with said fluid channel downstream of said fluid inlet, whereby upon connecting a fluid source to said hand-piece, fluid is transferred from said fluid inlet through said fluid channel and dispensed from said body portion through said fluid outlet.

2. A utility hand-piece according to claim 1, wherein said body portion defines a plurality of divided fluid channels therein communicating with said fluid inlet.

3. A utility hand-piece according to claim 2, and comprising a plurality of fluid outlets communicating with respective fluid channels.

4. A utility hand-piece according to claim 1, wherein said body portion defines three divided fluid channels therein communicating with said fluid inlet.

5. A utility hand-piece according to claim 4, and comprising at least three fluid outlets communicating with respective fluid channels.

6. A utility hand-piece according to claim 1, wherein said body portion comprises at least one finger opening adapted for receiving a finger of the user.

7. A utility hand-piece according to claim 6, wherein said finger opening comprises a finger loop.

8. A utility hand-piece according to claim 1, wherein said body portion comprises a plurality of finger openings adapted for receiving respective fingers of the user.

9. A utility hand-piece according to claim 8, and comprising a plurality of fluid outlets located proximate respective finger openings.

10. A utility hand-piece according to claim 1, and comprising an adjustable wrist strap attached to said body portion and adapted for wrapping around a wrist of the user.

11. A utility hand-piece for being worn on a hand of a user, said hand-piece comprising:

a wrist portion adapted for covering a wrist of the user;

a body portion attached to said wrist portion and adapted for covering at least a portion of the hand, said body portion defining at least one finger opening adapted for receiving a finger of the user, and said body portion comprising overlying top and bottom layers joined together along a plurality of longitudinal channel lines, wherein adjacent ones of said longitudinal channels lines cooperate to define at least one fluid channel in said body portion, said fluid channel being formed between said longitudinal channel lines and between said top and bottom layers of said body portion, and wherein each longitudinal channel line forms a seam in said body portion;

a fluid inlet formed with said body portion and communicating with said fluid channel; and a fluid outlet formed with said body portion proximate said finger opening and communicating with said fluid channel downstream of said fluid inlet, whereby upon connecting a fluid source to said hand-piece, fluid is transferred from said fluid inlet through said fluid channel and dispensed from said body portion through said fluid outlet.

12. A utility hand-piece according to claim 11, wherein said body portion defines a plurality of divided fluid channels therein communicating with said fluid inlet.

13. A utility hand-piece according to claim 12, and comprising a plurality of fluid outlets communicating with respective fluid channels.

14. A utility hand-piece according to claim 11, wherein said body portion defines three divided fluid channels therein communicating with said fluid inlet.

15. A utility hand-piece according to claim 14, and comprising at least three fluid outlets communicating with respective fluid channels.

16. A utility hand-piece according to claim 11, wherein said body portion comprises a plurality of finger openings adapted for receiving respective fingers of the user.

17. A utility hand-piece according to claim 16, and comprising a plurality of fluid outlets located proximate respective finger openings.

18. A utility hand-piece according to claim 11, wherein said wrist portion comprises an adjustable strap having complementary hook and loop fasteners.

* * * * *